US010585381B1

(12) United States Patent
Takenaka

(10) Patent No.: US 10,585,381 B1
(45) Date of Patent: Mar. 10, 2020

(54) IMAGE FORMING APPARATUS AND ADJUSTMENT METHOD OF IMAGE DENSITY

(71) Applicant: TOSHIBA TEC KABUSHIKI KAISHA, Tokyo (JP)

(72) Inventor: Sunao Takenaka, Odawara Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/144,466

(22) Filed: Sep. 27, 2018

(51) Int. Cl.

| | |
|---|---|
| ***G03G 15/00*** | (2006.01) |
| ***G03G 15/01*** | (2006.01) |
| ***G03G 15/043*** | (2006.01) |
| ***G03G 15/09*** | (2006.01) |
| ***G03G 15/06*** | (2006.01) |
| ***G03G 15/16*** | (2006.01) |
| *G03G 15/08* | (2006.01) |

(52) U.S. Cl.
CPC ..... *G03G 15/5054* (2013.01); *G03G 15/0189* (2013.01); *G03G 15/043* (2013.01); *G03G 15/065* (2013.01); *G03G 15/0907* (2013.01); *G03G 15/1675* (2013.01); *G03G 15/0849* (2013.01); *G03G 2215/00059* (2013.01); *G03G 2215/00067* (2013.01)

(58) Field of Classification Search
CPC ..... G03G 15/5054; G03G 15/0189; G03G 15/043; G03G 2215/00067; G03G 2215/00059; G03G 15/5062; G03G 15/0907; G03G 15/065; G03G 15/8049; G03G 15/1675; G03G 15/5058; G03G 2215/0888
USPC ..... 399/15
See application file for complete search history.

(56) References Cited

U.S. PATENT DOCUMENTS

| | | | | |
|---|---|---|---|---|
| 4,684,243 | A * | 8/1987 | Minor | G03G 15/5062 399/403 |
| 6,160,969 | A * | 12/2000 | Ishigaki | G03G 15/1675 399/49 |
| 6,327,445 | B1 | 12/2001 | Honda et al. | |
| 7,587,151 | B2 * | 9/2009 | Hanada | G03G 15/2064 399/15 |
| 2006/0238811 | A1 * | 10/2006 | Soma | G03G 15/55 358/1.16 |
| 2009/0196638 | A1 * | 8/2009 | Sukesako | G03G 15/0131 399/45 |
| 2009/0231604 | A1 * | 9/2009 | Miura | G03G 15/0194 358/1.9 |

* cited by examiner

*Primary Examiner* — David M. Gray
*Assistant Examiner* — Laura Roth
(74) *Attorney, Agent, or Firm* — Kim & Stewart LLP

(57) ABSTRACT

An image forming apparatus includes a developing unit, a transfer unit, a power source unit configured to supply a developing bias voltage to the developing unit and a transfer bias voltage to the transfer unit, and an input device to receive an image density evaluation. A processor adjusts the developing bias voltage when an evaluation input indicating a defect in the image density is received. If, after the first adjustment, another evaluation input indicating a defect in image density is received, the processor adjusts one of the developing bias voltage, the transfer bias voltage, or the toner density in the developing unit.

17 Claims, 8 Drawing Sheets

IMAGE FORMING APPARATUS AND ADJUSTMENT METHOD OF IMAGE DENSITY

FIELD

Embodiments described herein relate generally to an image forming apparatus and an adjustment method of an image density.

BACKGROUND

Various methods for adjusting image density of an image forming apparatus are known in the related art. For example, a method in which light is reflected off a toner image and detected by an optical sensor so as to estimate the amount of toner adhesion and then a developing bias voltage is controlled based on the estimated toner adhesion amount to adjust the image density. Another method of adjusting the image density is by replenishing toner in a developing unit of the image forming apparatus or by discharging toner.

DETAILED DESCRIPTION

Figure 1:
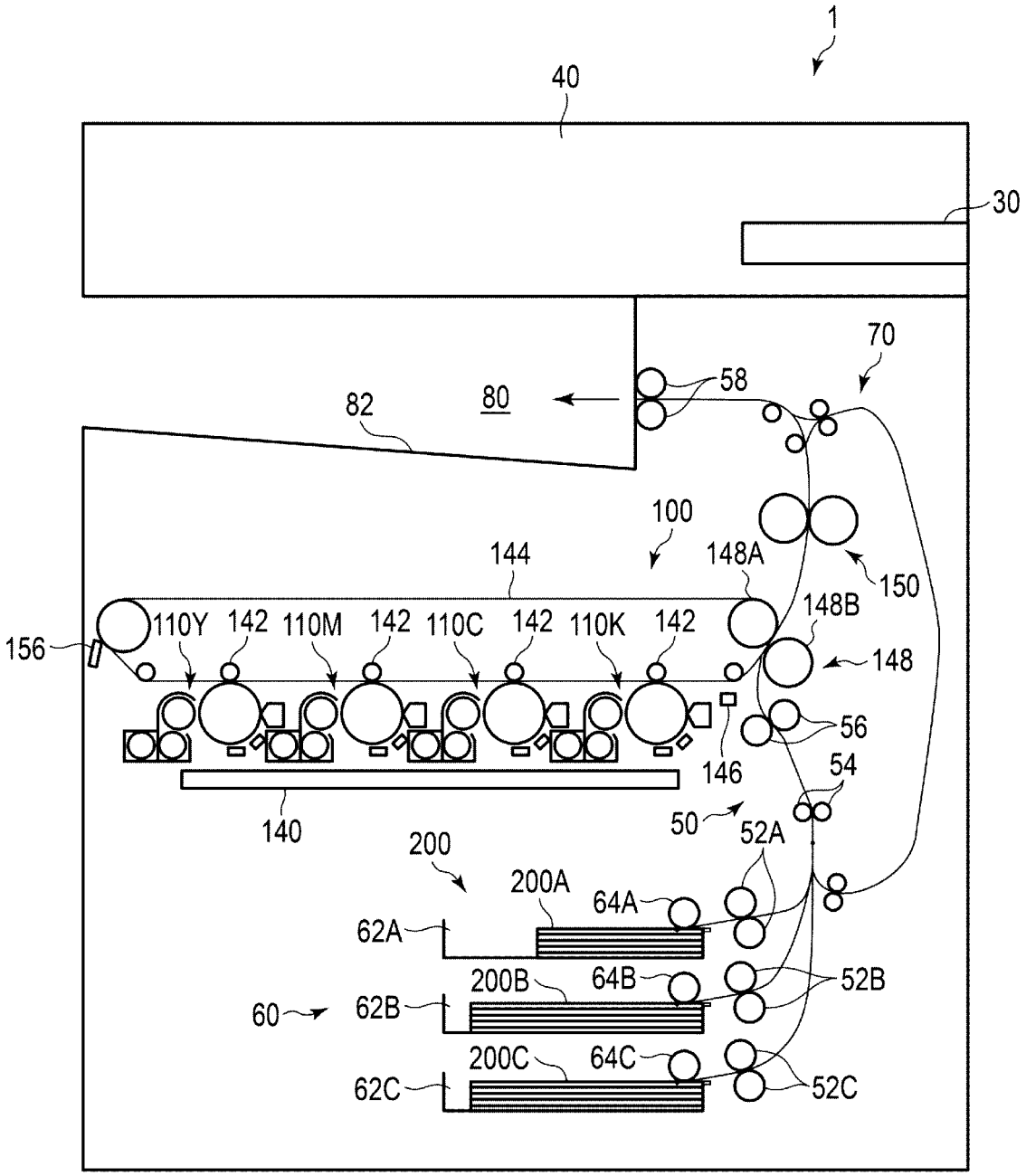
FIG. 1 depicts an image forming apparatus according to an embodiment.

In general, according to one embodiment, an image forming apparatus includes a developing unit configured to supply a toner to an image carrier and form a toner image thereon, a transfer unit configured to transfer the toner image on the image carrier to a recording medium and thereby form an image on the recording medium, and a power source unit configured to supply a developing bias voltage to the developing unit and a transfer bias voltage to the transfer unit. The image forming apparatus also includes an input device configured to receive an evaluation input from a user. The evaluation input indicates a user evaluation (e.g., appropriate, high, low, etc.) of an image density of the image on the recording medium. A processor is configured to control an image density adjustment operation including. The image density adjustment operation includes: performing a first adjustment for adjusting the developing bias voltage when the input device receives an evaluation input indicating that the image density is not appropriate according to the user evaluation, entering an adjustment mode when the input device receives an evaluation input indicating that the image density is not appropriate according to the user evaluation after the first adjustment has been performed, and performing any one of an adjustment of the developing bias voltage, an adjustment of the transfer bias voltage, and an adjustment of the toner density in the developing unit as a second adjustment in the adjustment mode in accordance with the evaluation input received after the first adjustment.

Density defects may occur in an image formed on the recording medium. In such a case, generally, a service engineer is requested to deal with the defects. There are various causes of the density defects, and the density defects do not always occur due to the same cause. For example, the causes may be failure relating to the developing unit or the transfer unit of the image forming apparatus. The causes are generally not easily determined by a person who is not a very experienced technician or a service engineer. If a person who has little experience tries various adjustments one by one, it may be a waste of time depending on the particular order in which the adjustments (and subsequent test images) are performed.

In addition, there may be occasions in which an apparent density defect in not actually a density defect but is rather an instance in which current print output settings are merely not matched to an end user' preference. Such apparent density defects are not actual faults or errors in the image forming apparatus. In such a case, the end user could possibly deal with the apparent defect by standard adjustments of output settings, but a service engineer may still be requested to meet the end user's preferences and expectations in this situation.

In the image forming apparatus according to the present embodiment, it is possible to effectively deal with image density defects.

Hereinafter, an example embodiment will be described with reference to drawings.

Figure 2:
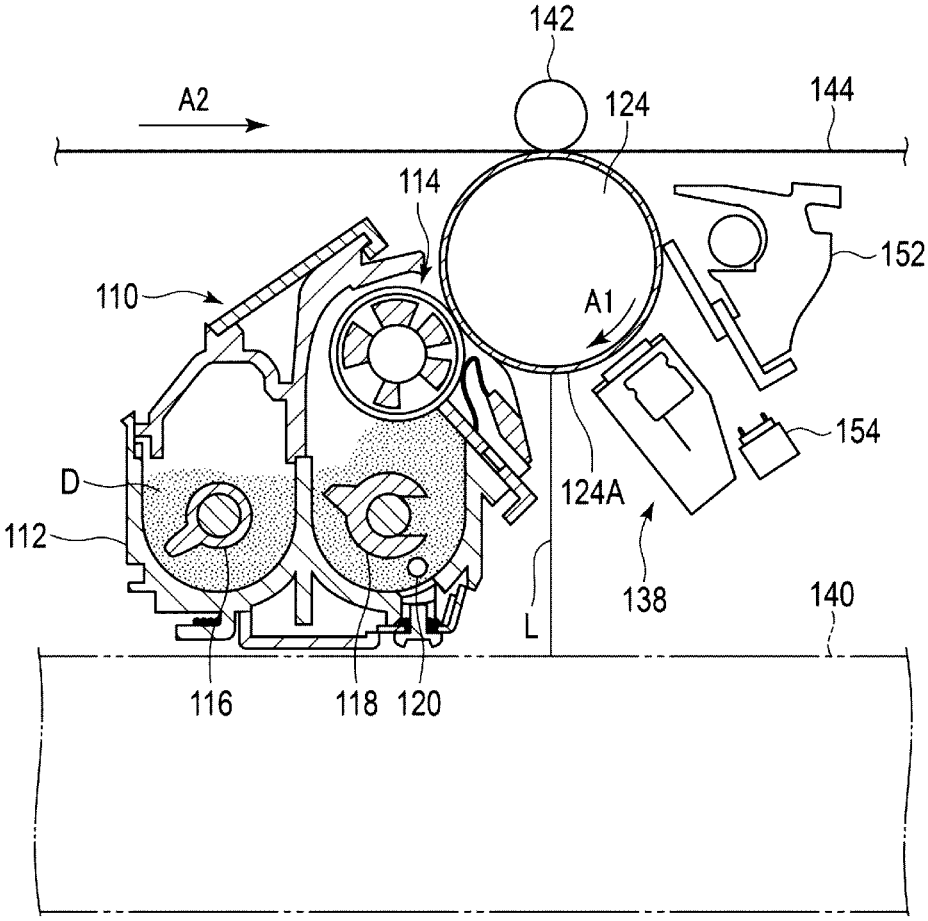
FIG. 2 depicts aspects related to a developing unit of the image forming apparatus.
Figure 3:
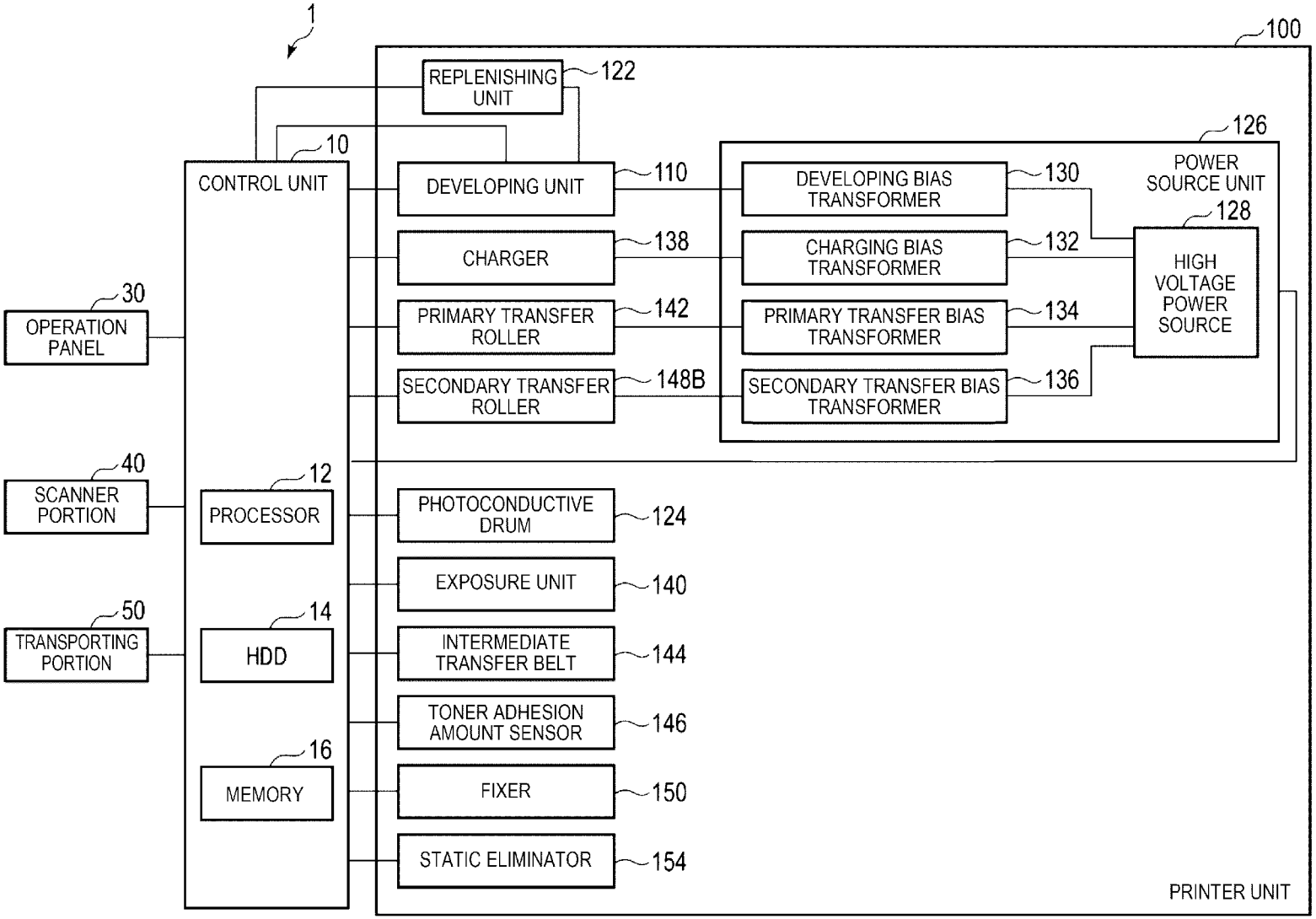
FIG. 3 is a block diagram illustrating aspects the image forming apparatus.

FIGS. 1 to 3 are views illustrating an image forming apparatus 1 according to an embodiment. The image forming apparatus 1 is, for example, a multi-functional peripheral (MFP) device that has the capability of forming an image on a recording medium, such as paper. The image forming apparatus 1 may include an image forming (printer) function, a reading (scanning) function, a copy function, a facsimile (fax machine) function, and the like. The image forming apparatus 1 realizes the image forming function by forming a toner image on the recording medium. The recording medium is not limited to paper, and also cloth, plastic film, label sheets, or the like can be printed with text characters and/or graphics. The image forming apparatus 1 is, for example, a so-called "quadruple tandem intermediate transfer system" to be further described below.

A density of the image formed on the recording medium (that is, "image density") is evaluated in accordance with the user's subjective preferences. The user may be an end user or may also be an administrator, such as a service engineer, of the image forming apparatus 1. When the user perceives that the density of the image is not appropriate when evaluating the image output on the recording medium, the user performs an input operation to the image formation apparatus 1 to indicate that the density is not appropriate, that is, an input which indicates that the image density needs to be changed. The image forming apparatus 1 receives this input operation, and one adjustment of a plurality of possible adjustments selected in advance is performed. In the embodiment, various adjustments are performed until the density of the image is determined as appropriate in accordance with the user's preferences.

In other words, the image forming apparatus 1 performs various adjustments until an input is received from the user indicating that the image density is satisfactory. The image forming apparatus 1 performs an image density adjustment by repeating the same adjustment or trying different adjustments. If image forming apparatus 1 does not receive input indicating the image density is satisfactory even after the various adjustments have been performed, then the image forming apparatus provides a notification that intervention by a user is necessary.

The image forming apparatus 1 includes a control unit 10, an operation panel 30, a scanner portion 40, a transporting portion 50, an accommodating portion 60, a paper discharging portion 80, and a printer unit 100.

The control unit 10 includes, for example, a processor 12, a hard disk drive (HDD) 14, and a memory 16. The processor 12 may be a central processing unit (CPU). The HDD 14 is a mass storage unit which stores programs to be executed by the processor 12, various parameters, and the like. Instead of the HDD 14, a storage such as a solid state drive (SSD) may be used. The memory 16 may be a memory unit such as a read only memory (ROM) or a random access memory (RAM). The processor 12 executes, for example, programs stored in the HDD 14 or the memory 16. The HDD 14 or the memory 16 stores, for example, image data generated by the scanner portion 40 or image data input from an external I/F through a network. In some embodiments, the control unit 10 may be constituted by an application specific integrated circuit (ASIC) or a field programmable gate array (FPGA).

The operation panel 30 is, for example, a touch panel in which a display device and an inputting device are integrally formed with each other. Instead of the operation panel 30, an inputting device such as inputting keys or buttons, and a display device separate from the inputting device are may be used.

The operation panel 30 may be a liquid crystal display, an organic electro luminescence (EL) display, and the like. The operation panel 30 displays various information relating to the image forming apparatus 1 and may function as a display device. In addition, the operation panel 30 receives an inputting operation from a user an may function as an inputting device. The operation panel 30 outputs a command signal to the control unit 10 in accordance with the received input(s). For example, the operation panel 30 receives an inputting operation for forming an image and generates a command signal for execution of image formation processes. The operation panel 30 outputs the generated command signal to the control unit 10.

The scanner portion 40 includes, for example, an image capturing element such as a charge coupled device (CCD). The scanner portion 40 reads an image from a recording medium placed at a predetermined position and generates image data based on the image as read by the image capturing element. The scanner portion 40 outputs the generated image data to the control unit 10. The generated image data may also or instead be output to the printer unit 100. In addition, the generated image data may be transmitted to the other information processing apparatuses through a network.

The accommodating portion 60 includes paper feeding cassettes 62A, 62B, and 62C as illustrated in FIG. 1. The three paper feeding cassettes 62A, 62B, and 62C are illustrated, but the number of the paper feeding cassettes may be any number. The paper feeding cassettes 62A, 62B, and 62C are respectively accommodate the different types of paper 200A, 200B, and 200C having a predetermined size. Pick-up rollers 64A, 64B, and 64C are respectively disposed above the paper feeding cassettes 62A, 62B, and 62C. The pick-up rollers 64A, 64B, and 64C respectively take out the recording media one by one from the paper feeding cassettes 62A, 62B, and 62C. The pick-up rollers 64A, 64B, and 64C respectively supply a recording medium 200 to the transporting portion 50.

The transporting portion 50 transports the recording medium 200. The transporting portion 50 includes first transporting rollers 52A, 52B, and 52C, a second transporting roller 54, and a registration roller 56 on a transporting path portion before (upstream) a position at which an image is transferred onto the recording medium 200. In the transporting portion 50, the recording medium supplied by the pick-up rollers 64A, 64B, and 64C is transported to a transfer unit 148 by the first transporting rollers 52A, 52B, and 52C through the second transporting roller 54 and the registration roller 56. The registration roller 56 transports the recording medium to the transfer unit 148. A fixer 150 and a third transporting roller 58 (of the transporting portion 50) are disposed on the transporting path after (downstream) the position at which the image is formed on the recording medium 200. In addition, a reversing portion 70 for flipping the recording medium when an image is being formed on both sides of the recording medium The reversing portion is disposed on the transporting portion 50.

The paper discharging portion 80 receives the recording medium from the printer unit 100 through the third transporting roller 58. The paper discharging portion 80 may be positioned in an opening portion and/or be a tray including a paper receiving surface 82.

The printer unit 100 may form an image based on the image data generated by the scanner portion 40. In addition, the printer unit 100 may form an image based on the image data transmitted by other information processing apparatuses through a network.

The printer unit 100 includes a developing unit 110, a replenishing unit 122, a photoconductive drum 124, a power source unit 126, a charger 138, an exposure unit 140, a primary transfer roller 142, an intermediate transfer belt 144, a toner adhesion amount sensor 146, the transfer unit 148, the fixer 150, a photoconductive cleaner 152, a static eliminator 154, and a transfer belt cleaner 156.

The printer unit 100 includes the number of the developing units 110 corresponding to the number of toners to be handled. In the present embodiment, as illustrated in FIG. 1, a developing unit 110Y corresponding to a yellow (Y) toner, a developing unit 110M corresponding to a magenta (M) toner, a developing unit 110C corresponding to a cyan (C) toner, and a developing unit 110K corresponding to a black (K) toner are provided in the printer unit 100.

FIG. 2 is a view illustrating an example of elements in the vicinity of a developing unit 110 of the printer unit 100. Since the developing units 110Y, 110M, 110C, and 110K and the elements in the vicinity thereof are respectively configured to be the same as each other, only one developing unit 110 and the vicinity thereof will be illustrated and described. In the vicinity of the developing unit 110, the photoconductive drum 124, the charger 138, the exposure unit 140, the primary transfer roller 142, the intermediate transfer belt 144, and the static eliminator 154 are provided. These components are controlled by the control unit 10.

The photoconductive drum 124 includes a photoconductive layer 124A on the surface thereof. The photoconductive drum 124 rotates in a clockwise direction (e.g., the direction illustrated by arrow A1 in FIG. 2) by driving a motor controlled by the control unit 10. Near the photoconductive drum 124, the charger 138, the exposure unit 140, the developing unit 110, the primary transfer roller 142, the intermediate transfer belt 144, the photoconductive cleaner 152, and the static eliminator 154 are disposed.

The charger 138 uniformly charges the photoconductive layer 124A. The charger 138 charges, for example, the outer circumferential surface of the photoconductive drum 124 to a negative polarity.

Emissions of the exposure unit 140 are controlled by the control unit 10 based on the image data. The exposure unit 140 irradiates the surface of the photoconductive drum 124 with laser light L supplied through an optical system includes an element such as a polygon mirror. The exposure unit 140 forms an electrostatic pattern (also referred to as an electrostatic latent image) corresponding to image data at a position irradiated with the laser light L on the surface of the photoconductive drum 124. The exposure unit 140 may irradiate the surface of the photoconductive drum with a light emitting diode (LED) light beam instead of the laser light L.

The developing unit 110 (see FIG. 2) includes a developer accommodating portion 112, a developing roller 114, a first mixer 116, a second mixer 118, and a toner density sensor 120. The developing unit 110 supplies a developer D from the developer accommodating portion 112 to the photoconductive drum 124.

The developer accommodating portion 112 is a container for storing the developer D. The developer D is a mixture of a carrier made of magnetic fine particles and toner particles. When the developer D is stirred, the toner particles are frictionally charged. Accordingly, the toner particles are adhered to a surface of the carrier because of an electrostatic force.

Inside the developer accommodating portion 112, the developing roller 114, the first mixer 116, and the second mixer 118 are disposed. The developing roller 114 includes, for example, a magnetic substance, such as a magnet, in which a north pole and a south pole are alternately arranged along a circumferential shape. The developing roller 114 is rotated in a counterclockwise direction by driving a developing motor which is not illustrated. The first mixer 116 and the second mixer 118 stir the developer D in the developer accommodating portion 112. In addition, the first mixer 116 and the second mixer 118 transport the developer D. Particularly, the second mixer 118 disposed under the developing roller 114 supplies the developer D to a surface of the developing roller 114. The supplied developer D is adhered on a surface of the developing roller 114 in accordance with a magnetic field distribution generated due to the magnetic substance of the developing roller 114.

When the electrostatic latent image is formed on the surface of the photoconductive drum 124, the toner is adhered to the electrostatic latent image of the photoconductive drum 124 from the developing roller 114. Accordingly, the toner image is formed on the surface of the photoconductive drum 124.

The toner density sensor 120 is disposed inside the developer accommodating portion 112. The toner density sensor 120 detects a toner density Dt within the developer accommodating portion 112. The toner density Dt is expressed by a ratio (e.g., toner/carrier) of the toner and the carrier of the developer D in the developer accommodating portion 112. The toner density sensor 120 outputs the toner density Dt to the control unit 10.

The replenishing unit 122 adds toner to the developing unit 110. The replenishing unit 122 supplies the additional toner from a toner cartridge or the like in accordance with a control command output from the control unit 10, to the developer accommodating portion 112.

The intermediate transfer belt 144 is sandwiched between the primary transfer roller 142 and the photoconductive drum, and the primary transfer roller faces the photoconductive drum 124. The intermediate transfer belt 144 is sandwiched between the primary transfer roller 142 and the photoconductive drum, and the primary transfer roller comes into contact with the surface of the photoconductive drum 124. The primary transfer roller 142 transfers the toner image on the surface of the photoconductive drum 124 to the intermediate transfer belt 144, this is referred to as a primary transfer.

The intermediate transfer belt 144 is an endless belt as illustrated in FIG. 1. The intermediate transfer belt 144 is driven by a motor and is moved in a direction illustrated by an arrow A2 in FIG. 2.

The photoconductive cleaner 152 is disposed on a downstream of a position where the toner image on the outer circumferential surface of the photoconductive drum 124 is transferred onto the outer circumferential surface of the intermediate transfer belt 144 in a circumferential direction of the photoconductive drum 124. The photoconductive cleaner 152 removes the toner transferred onto the outer circumferential surface of the photoconductive drum 124 after the toner image is transferred onto the outer circumferential surface of the intermediate transfer belt 144 from the photoconductive drum 124.

The static eliminator 154 is downstream of the position of the photoconductive cleaner 152 in the circumferential direction of the photoconductive drum 124. The static eliminator 154 irradiates the surface of the photoconductive drum 124 with light. Accordingly, charges remaining on the photoconductive layer 124A are removed.

As illustrated in FIG. 1, the toner adhesion amount sensor 146 is disposed between the primary transfer roller 142 and the transfer unit 148 in a moving direction of the intermediate transfer belt 144 so as to face a transfer surface of the intermediate transfer belt 144. The toner adhesion amount sensor 146 detects the amount of the toner on the intermediate transfer belt 144. The toner adhesion amount sensor 146 outputs the detected toner adhesion amount to the control unit 10.

The transfer unit 148 includes a supporting roller 148A and a secondary transfer roller 148B, which sandwich the recording medium from both sides in a thickness direction. The supporting roller 148A is a driving roller of the intermediate transfer belt 144. Therefore, the intermediate transfer belt 144 is also considered a part of the transfer unit 148. The intermediate transfer belt 144 is sandwiched between the secondary transfer roller 148B and the supporting roller, and the secondary transfer roller 148B faces the supporting roller 148A. The transfer unit 148 transfers the toner image on a transfer surface of the intermediate transfer belt 144 to the surface of the recording medium, which is referred to as a secondary transfer.

The transfer belt cleaner 156 is disposed between the transfer unit 148 and the developing unit 110 in the moving direction of the intermediate transfer belt 144 as illustrated in FIG. 1. The transfer belt cleaner 156 removes the toner transferred onto the transfer surface of the intermediate transfer belt 144 after the toner image is transferred onto the recording medium from the intermediate transfer belt 144.

The fixer 150 is disposed on a transporting path after the toner image is transferred onto the recording medium. The fixer 150 applies heat and pressure to the recording medium. The fixer 150 fixes the toner image onto the recording medium with heat and pressure.

The power source unit 126 respectively supplies a high voltage to the developing unit 110, the charger 138, the primary transfer roller 142, and the secondary transfer roller 148B by a control of the control unit 10. In this context, high voltage means, for example, a voltage from several hundred volts (V) to several kilovolts (kV). As illustrated in FIG. 3, the power source unit 126 includes, for example, a high voltage power source 128, a developing bias transformer 130, a charging bias transformer 132, a primary transfer bias transformer 134, and a secondary transfer bias transformer 136.

The high voltage power source 128 generates a high voltage from, for example, an input voltage of several tens V. The various transformers 130, 132, 134, and 136 convert the voltage generated by the high voltage power source 128 and supply a bias voltage which is suitable for various portions of the apparatus. The developing bias transformer 130 supplies the developing bias voltage to the developing unit 110. The charging bias transformer 132 supplies a charge bias voltage to the charger 138. The primary transfer bias transformer 134 supplies a primary transfer bias voltage to the primary transfer roller 142. The secondary transfer bias transformer 136 supplies a secondary transfer bias voltage to the secondary transfer roller 148B.

An image forming operation by the image forming apparatus 1 will be described. A user performs, for example, the inputting operation for forming an image from the operation panel 30. The image forming apparatus 1 receives the inputting operation. The control unit 10 receives the inputting operation and causes the transporting portion 50 transport the recording medium 200. In addition, the control unit causes the printer unit 100 to perform the image forming operation.

The transporting portion 50 transports the recording medium 200 from the accommodating portion 60. The charger 138 receives the charge bias voltage from the power source unit 126 and charges the photoconductive layer 124A of the photoconductive drum 124. The exposure unit 140 irradiates the photoconductive layer 124A with the laser light L based on the input image data. An electrostatic latent image is formed at a position on the photoconductive layer 124A to which the laser light L is applied. The developing unit 110 supplies the developer D to the photoconductive layer 124A on which the electrostatic latent image is formed.

For example, the developing unit 110Y receives the developing bias voltage from the power source unit 126 and develops the electrostatic latent image on the surface of the photoconductive drum 124 using a yellow (Y) toner in the developing unit 110Y. The developing unit 110M develops the electrostatic latent image on the surface of the photoconductive drum 124 using a magenta (M) toner in the developing unit 110M. The developing unit 110C develops the electrostatic latent image on the surface of the photoconductive drum 124 using a cyan (C) toner in the developing unit 110C. The developing unit 110K develops the electrostatic latent image on the surface of the photoconductive drum 124 using a black (K) toner in the developing unit 110K.

The photoconductive drum 124 receives the primary transfer bias voltage being applied to the primary transfer roller 142 from the power source unit 126 and transfers a toner image to a transfer surface of the intermediate transfer belt 144. For example, a yellow (Y) toner image, a magenta (M) toner image, a cyan (C) toner image, and a black (K) toner image are transferred onto the outer circumferential surface of the intermediate transfer belt 144.

The intermediate transfer belt 144 receives the secondary transfer bias voltage being applied from the power source unit 126 to the secondary transfer roller 148B, and the transfer unit 148 transfers a toner image on the recording medium 200. The fixer 150 applies heat and pressure to the recording medium 200 and fixes the toner image transferred onto the recording medium 200.

Also, when the image is to be formed on both surfaces of the recording medium, the reversing portion 70 reverses the recording medium 200 after the fixing process. The reversing portion 70 transports the reversed recording medium 200 to the second transporting roller 54 of the transporting portion 50 and an image is formed on the second side of the recording medium 200.

The recording medium 200 on which the toner image is fixed is discharged from the paper discharging portion 80. Therefore, the image forming operation ends.

In the embodiment, a user evaluates whether or not a density of the image formed on the recording medium is appropriate after the image forming operation described above. An image being used for a density evaluation may be a test pattern image prepared in advance and stored in the image forming apparatus 1 or may be any image according to user selection or the like. When the user determines that the density of the image is not appropriate, the user causes the operation panel 30 to display a screen for inputting an evaluation of the image. The image forming apparatus 1 executes adjustments based on inputs by the user.

Figure 4:
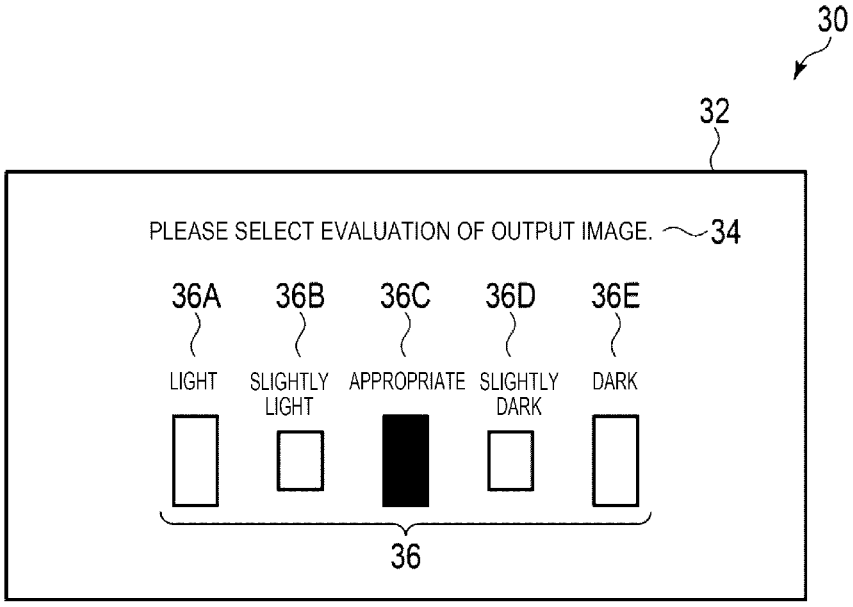
FIG. 4 is a diagram illustrating an example of a display screen by which evaluation is input.

FIG. 4 is a diagram illustrating an example of a screen displayed on the operation panel 30 when the user is evaluating the density of the printed image. For example, a message 34 of "please select evaluation of output image" and evaluation input portion 36 are displayed on the operation panel 30. The evaluation input portion 36 includes, for example, a first inputting portion 36A indicating "light", a second inputting portion 36B indicating "slightly light", a third inputting portion 36C indicating "appropriate", a fourth inputting portion 36D indicating "slightly dark", and a fifth inputting portion 36E indicating "dark". In FIG. 4, the first to the fifth inputting portions 36A to 36E may be a frame displayed with characters indicating the density but may be other display modes. The user inputs evaluations to the image forming apparatus 1 by selecting any one of the first to the fifth inputting portions 36A to 36E.

In FIG. 4, one of five different evaluations can be input from the evaluation input portion 36, but the number gradations in the evaluations which can be input are not limited thereto. It is sufficient that the user evaluation indicates whether or not the image is considered appropriate, in other words, whether or not it is necessary to change an image density. For example, in an embodiment, three types of evaluations of "light", "appropriate", and "dark" can be used.

In addition, the evaluation inputting device is not limited to a tactile inputting device such as the operation panel 30 or inputting keys. The evaluation inputting device may be a voice inputting device. For example, the voice inputting device, including a microphone and a speaker, can be provided in the image forming apparatus 1. The image forming apparatus 1 may output the message 34 and input an evaluation based on voice information acquired from the voice inputting device. For example, the user speaks any one keyword of "light", "slightly light", "appropriate", "slightly dark", and "dark" as voice, and thus the voice inputting device may recognize the voice so as to input the evaluation to the image forming apparatus 1.

With reference to FIGS. 5A to 5C and 6, adjustments of the image density will be described. In ACT 101, the image forming apparatus 1 determines whether or not an input other than "appropriate" is received as evaluation of the image. Here, the inputs other than "appropriate" would indicate, "light", "slightly light", "slightly dark" and "dark". When the inputs other than "appropriate" are received (Yes), a process proceeds to ACT 102. When the input of "appropriate" is received (No), the process ends. The image forming apparatus 1 may finish to display the screen illustrated in FIG. 4.

A case in which the evaluation of "light" or "slightly light" from among the possible inputs other than "appropriate" in ACT 101, that is, an evaluation of lack of the image density is input, is considered.

In a case of the lack of the image density, likely causes thereof are broadly divided into two causes as follows:

a1) changing of a charged amount on a toner in the developer D a2) particular recording media 200 type is outside of the assumed electrical characteristics for the recording medium 200 (for example, electrical resistance of a recording medium 200 is outside of the assumed parameters).

Between the two causes, cause a1 is more likely to occur. The charged amount on the toner in the developer D is generated due to frictional electrification between toner particles and carrier particles. Therefore, under the influence of temperature/humidity changes in the outside air or a change in usage (more frequent/less frequent usage), the charged amount on the toner is likely to be significantly varied. Since ease of developing with the toner is changed by the charged amount on the toner, it is considered that a cause a1 is most likely to occur.

A countermeasure which can be taken when the image density is deteriorated due to a change in the charged amount on the toner as a cause, two adjustments as follows are considered:

b1) increasing developing bias voltage Vd so as to improve a development efficiency b2) replenishing a toner to the developing unit 110 from the replenishing unit 122 so as to increase the toner density Dt in the developing unit 110.

Between these two adjustments, there is a possibility that an unexpectedwaiting time may occur when adjustment b2 is performed. In addition, if the toner density is normal, if the toner is replenished the density increases from a normal toner density to a high toner density, which often causes an adverse effect. For example, there is a possibility that failure such as toner scattering or fogging image may occur. Furthermore, re-correcting to the normal toner density from the high toner density is not easy. Therefore, it is preferable that the image density be adjusted without changing the toner density as much as possible at first, that is, adjustment b1 to be tried first. Adjustment b2 is preferably tried only if other adjustments are not effective.

An adjustment when the evaluation of "dark" or "slightly dark" among the inputs other than "appropriate" in ACT 101, that is, evaluation in which the image density is dark is input is considered.

When the image is dark, the possibility the failure occurred in the transfer unit 148 is very low. This is because transferring cannot be performed when the toner exceeds 100%, and the density does not become dark by over-transferring. Therefore, adjustment of the transfer unit 148 can be a waste of time in the first place. Therefore, from the viewpoint of efficiency of an adjustment time, the image density adjustment concentrates on adjustment of the developing bias voltage.

It is highly possible that the cause of the image density becoming dark may result from a change of the charged amount of the toner in the developer D. For example, the toner is easily developed when the charged amount of the toner in the developer D is deteriorated, and the image density increases as a result. Two adjustments as follows are considered as a method of dealing with the causes:

c1) lowering the developing bias voltage and lowering the developing efficiency c2) decreasing the toner density Dt in the developing unit 110 by developing and discharging a predetermined toner image.

Between these two adjustments, with cause c2 there is a possibility that an unexpected waiting time may occur, also if the toner density is normal, since the density is lowered to a far lower density than the normal toner density, which often causes an adverse effect. For example, there is a possibility that failure such as pulling out of carriers may occur. In addition, returning to the normal toner density from the low toner density is also not easy. Therefore, as the same manner as increasing the image density, it is preferable that the image density be adjusted without changing the toner density as much as possible at first, that is, cause c1 be investigated. And cause c2 is preferably tested if other adjustments are not effective.

Therefore, when the image forming apparatus 1 is determined to receive the inputs other than "appropriate" in ACT 101, even "light" or "slightly light", or "dark" or "slightly dark", the image forming apparatus 1 firstly starts to adjust the developing bias voltage Vd.

Figure 6:
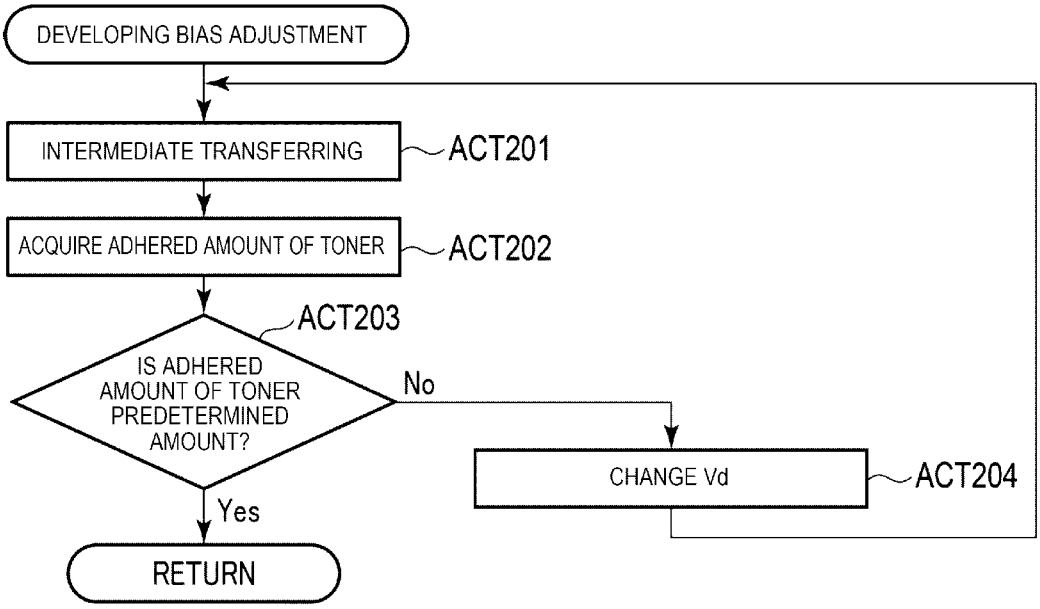
FIG. 6 is a flowchart illustrating aspects of an adjustment of a developing bias voltage.

In ACT 102, the image forming apparatus 1 adjusts the developing bias voltage as the first adjustment. FIG. 6 is a flow chart illustrating an example of the adjustment of the developing bias voltage in ACT 102.

In ACT 201, the image forming apparatus 1 develops the toner image for adjusting the density and transfers the toner image to the intermediate transfer belt 144. In ACT 202, the image forming apparatus 1 detects the toner adhesion amount of the toner image for adjusting the density on the intermediate transfer belt 144 using the toner adhesion amount sensor 146. The image forming apparatus 1 acquires the detected toner adhesion amount. In ACT 203, the image forming apparatus 1 determines whether or not the toner adhesion amount acquired in ACT 202 is a predetermined set amount. When the amount is a predetermined adhesion amount (Yes), the process returns. When the amount is determined not to be the predetermined adhesion amount (No), the process proceeds to ACT 204. In ACT 204, the image forming apparatus 1 changes the developing bias voltage Vd output from the power source unit 126. Also, the process returns to ACT 201. That is, the image forming apparatus 1 develops the toner image for adjusting the density again and repeats the processes from ACT 204 to ACTs 201 to 203 until the toner image is transferred onto the outer circumferential surface of the intermediate transfer belt 144 and the toner adhesion amount becomes a predetermined amount.

As described above, in the adjustment of the developing bias voltage in ACT 102, the image forming apparatus 1 adjusts the developing bias voltage Vd so that the toner adhesion amount at the primary transferring becomes a predetermined amount.

After ACT 102, the process proceeds to ACT 103. In ACT 103, the image forming apparatus 1 forms an image on the recording medium 200. That is, the image forming apparatus 1 transfers the toner image fixed to the intermediate transfer belt 144 by a predetermined amount using the transfer unit 148 to the recording medium 200 and discharges the recording medium 200 to the paper discharging portion 80 after the fixing process. In addition, as described later, a value of current flowing to the transfer unit 148 at the time of secondary transferring in ACT 103 is detected. After the image formation process is finished, in the image forming apparatus 1, a screen to which the evaluation of the density of the image is input is displayed again as illustrated in FIG. 4. A user inputs evaluation of the density of the output image in ACT 103 from the operation panel 30.

In ACT 104, the image forming apparatus 1 determines whether or not input of "appropriate" is received. When the input of "appropriate" is received (Yes), the image density adjustment is finished. When the inputs other than "appropriate" are received (No), the process proceeds to ACT 105. The image forming apparatus 1 is in an adjustment mode for performing further adjustment if inputs other than "appropriate" are received.

In ACT 105, the image forming apparatus 1 determines whether or not an input of "light" or "slightly light" is received. When the input is received (Yes), the process proceeds to ACT 106. When this input is determined not received (No), the process proceeds to ACT 126.

When the image density is not appropriate even after the adjustment of the developing bias voltage has been executed, it is considered that there may be a case where the toner density Dt in the developer D is abnormal or a case where electrical characteristics, such as electrical resistance, of the recording medium 200 being used by a user described above is deviated from an assumed range.

Since the adjustment of the secondary transfer bias voltage can be immediately changed by changing a setting value of the secondary transfer bias transformer 136, the adjustment does not take a long time. In addition, the detected electrical characteristics of the recording medium 200 are corrected by deviation from the assumed value, and thus an adverse effect is limited even when the correction becomes necessary. Therefore, the image forming apparatus 1 performs a secondary transfer bias adjustment as the second adjustment subsequent to the developing bias adjustment.

In the transfer unit 148, if the secondary transfer bias voltage being applied to the secondary transfer roller 148B is not sufficient or is excessive, it leads to lack of transferring to the recording medium 200 so as to cause the lack of the image density to occur. For example, representative paper from paper in circulation is selected, and a setting value of the secondary transfer bias voltage is selected in advance according to the electrical characteristics of the selected paper. Therefore, for example, when paper having a resistance greater than that of the assumed electrical resistance of the paper is used by a user, current flowing to the secondary transfer roller 148B is reduced, and lack of transferring occurs. If paper having resistance lower than the assumed value is used by a user, the current flowing to the secondary transfer roller 148B becomes too great, which also leads to the lack of transferring, and thus the lack of the image density occurs.

In the secondary transfer bias adjustment, first, deviation of the electrical resistance of the paper detected at the time of outputting an image in ACT 103 is checked. When the electrical resistance is deviated, the image forming apparatus 1 corrects the secondary transfer bias voltage Vt by a voltage calculated by [deviation amount of resistance]× [target current amount]. The paper resistance can be calculated as follows, for example.

Figure 7:
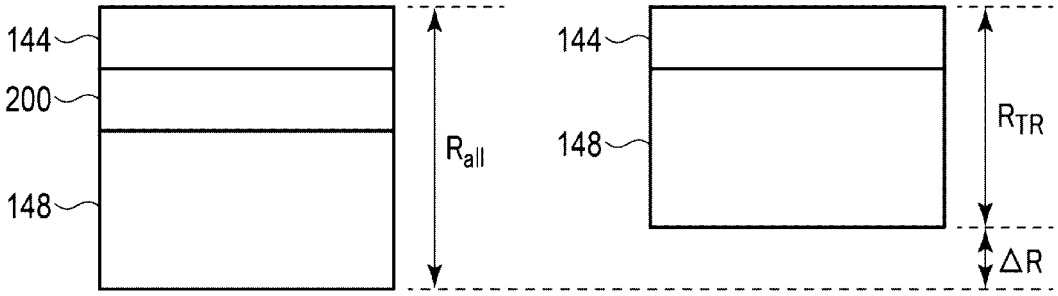
FIG. 7 is for describing aspects of a calculation of an electrical resistance of a recording medium.

First, when there is no paper during the secondary transferring, the current flowing to the transfer unit 148 is detected and then again when the paper passes through the transfer unit 148 during the secondary transferring. Subsequently, from a setting voltage, a current value detected when there is no paper, and a current value detected when the paper passes through, a first electrical resistance $R_{TR}$ of the intermediate transfer belt 144 and the secondary transfer roller 148B, and an electrical resistance of the intermediate transfer belt 144, the recording medium 200, and the secondary transfer roller 148B, that is, a second electrical resistance Ran including the paper are calculated. Also, a value ΔR obtained by subtracting the first electrical resistance $R_{TR}$ from the second electrical resistance $R_{all}$ is set to a paper resistance in this case (refer to FIG. 7).

Here, the electrical resistance values are discussed, but the disclosure is not limited thereto and a similar process may be conducted as long as there is an electrical characteristic value relating to the electrical resistance. For example, a voltage value when constant current flows may be used in a similar process.

Hereinafter, the secondary transfer bias adjustment in ACT 106 to ACT 114 will be described. In ACT 106, the image forming apparatus 1 detects a value of the current flowing to the transfer unit 148 when the transfer unit 148 has no paper.

In ACT 107, the image forming apparatus 1 calculates the first electrical resistance $R_{TR}$ and the second electrical resistance $R_{all}$ from the setting voltage, the current value detected in ACT 106, and for example, the current value detected in ACT 103. Also, the image forming apparatus 1 calculates the value ΔR obtained by subtracting the first electrical resistance $R_{TR}$ (right view of FIG. 7) from the second electrical resistance $R_{all}$ (left view of FIG. 7) as the paper resistance.

In ACT 108, the image forming apparatus 1 determines whether or not the resistance ΔR of the paper calculated in ACT 107 is significantly deviated from an assumed value. How much deviation is set to great deviation can be appropriately set according to the paper. When the resistance is deviated (Yes), the process proceeds to ACT 109. When the resistance is determined not to be deviated, the process proceeds to ACT 115.

In ACT 109, the image forming apparatus 1 determines whether or not deviation of the paper resistance from the assumed value, that is, a difference of the resistance ΔR is greater than a reference value. When the resistance is greater than a reference value (Yes), the process proceeds to ACT 110. When the resistance is smaller than a reference value (No), the process proceeds to ACT 111.

In ACT 110, the image forming apparatus 1 increases the secondary transfer bias voltage Vt being applied to the secondary transfer roller 148B from the power source unit 126. Otherwise, in ACT 111, the image forming apparatus 1 decreases the secondary transfer bias voltage Vt being applied to the secondary transfer roller 148B from the power source unit 126. Accordingly, a value of the secondary transfer bias voltage Vt is adjusted to be substantially the same as the assumed value.

After ACT 110 or ACT 111, the process proceeds to ACT 112. In ACT 112, the image forming apparatus 1 forms an image on the recording medium 200. After the image forming is completed, in the image forming apparatus 1, again, the screen for inputting the evaluation of the density of the image is displayed as illustrated in FIG. 4. The user inputs the evaluation of the density of the image output in ACT 112 from the operation panel 30.

In ACT 113, the image forming apparatus 1 determines whether or not the input of "appropriate" as the image evaluation is received. When the input of "appropriate" is received (Yes), the image density adjustment is finished. When the inputs other than "appropriate" are received (No), the process proceeds to ACT 114.

In ACT 114, the image forming apparatus 1 determines whether or not the input of "light" or "slightly light" is received. When the input is received (Yes), the process proceeds to ACT 115. When the input is determined not to be received (No), the process proceeds to ACT 126.

Most of the problems with a lack of the image density are solved by the adjustment of the developing bias voltage and the adjustment of the secondary transfer bias voltage. However, since the image density evaluations are performed in accordance with the user's subjectivity, the evaluation of "light" or "slightly light" is still performed. In such a case, if a preference of a user is quite dark or the toner density Dt of the developer D in the developing unit 110 must be adjusted. As described above, since the adjustment of the toner density of the developer D takes time, an adjustment of the image density when the preference of the user is assumed to be dark is preferentially performed, and the adjustment of the developing bias voltage is performed again. The image forming apparatus 1 performs the adjustment of the developing bias voltage as a third adjustment.

Through ACT 102, the toner image which is primarily transferred to the intermediate transfer belt 144 may already become a "predetermined toner adhesion amount". However, since the user still considers the image density to be "light" or "slightly light", a target toner adhesion amount is set to be higher than the "predetermined toner adhesion amount", and the adjustment of the developing bias voltage is performed in the same manner as that of the adjustment performed preferentially. For example, it is possible to set and adjust the developing bias voltage Vd so that the target toner adhesion amount increases step by step until the developing bias voltage increases to the upper limit voltage of developing bias transformer 130.

Hereinafter, the developing bias adjustment in ACT 115 to ACT 119 will be described. In ACT 115, the image forming apparatus 1 determines whether or not the developing bias voltage Vd rises. When the voltage is risen (Yes), the process proceeds to ACT 116. When the voltage is determined not to be risen (No), the process proceeds to ACT 120.

In ACT 116, the image forming apparatus 1 increases the developing bias voltage Vd. For example, an amount of the increase in the developing bias voltage Vd when the input of the evaluation is "slightly light" in ACT 114 is set to be less than that in a case of "light". A fine adjustment can be performed with such settings.

In ACT 117, the image forming apparatus 1 forms an image on the recording medium 200. After the image forming is completed, the screen for inputting the evaluation of the density of the image is again displayed (see FIG. 4). The user inputs the evaluation of the density of the image output in ACT 117 from the operation panel 30.

In ACT 118, the image forming apparatus 1 determines whether or not the input of "appropriate" as the evaluation of the image is received. When the input of "appropriate" is received (Yes), the image density adjustment is finished. When the inputs other than "appropriate" are received (No), the process proceeds to ACT 119.

In ACT 119, the image forming apparatus 1 determines whether or not the input of "light" or "slightly light" is received. When one of these inputs is received (Yes), the process returns to ACT 115. Also, the processes subsequent to ACT 115 are repeated. Meanwhile, when none of these inputs are received (No), the process proceeds to ACT 126.

With the adjustments so far, lack of density due to the lack of the developing bias voltage, lack of transferring due to the deviation of the paper resistance (electrical characteristics of paper), or lack of density due to the low target toner adhesion amount will be solved. Therefore, in a large percentage of cases, the adjustments may be finished.

However, when the user still evaluates the image density not to be appropriate, then finally, the toner density Dt in the developer D is increased by toner replenishment, and thus the image density increases. The image forming apparatus 1 performs an adjustment of the toner density (referred to as toner replenishment) as a fourth adjustment.

When the toner is rapidly replenished, it takes time until the toner which is newly added in the developer accommodating portion 112 to be sufficiently stirred and mixed by mixers 116 and 118. Therefore, an operation in which the toner is added and stirred for a certain time by the mixers 116 and 118 is repeatedly performed, and the toner density Dt gradually rises. In addition, there are many cases where the image density becomes too dark if the toner is replenished, but the image density may be made to be light during proceeding ACT 126.

Hereinafter, toner density adjustments in ACT 120 to ACT 124 will be described. In ACT 120, the image forming apparatus 1 determines whether or not the toner density Dt rises. For example, the image forming apparatus 1 sets an upper limit value of the toner density Dt in advance and determines whether or not the toner density Dt rises based on the detected value by the toner density sensor 120. When the density is increased (Yes), the process proceeds to ACT 121.

In ACT 121, the image forming apparatus 1 adds a toner using the replenishing unit 122. For example, a replenished amount of the toner when the evaluation is "slightly light" in ACT 118 and ACT 119 may be set to be smaller than that for a case of "light". A fine adjustment can be performed with such settings.

In ACT 122, the image forming apparatus 1 forms an image on the recording medium 200. After the image forming is completed, the screen for inputting the evaluation of the density of the image is again displayed 4 as shown in FIG. 4. The user inputs the evaluation of the density of the image output in ACT 122 from the operation panel 30.

In ACT 123, the image forming apparatus 1 determines whether or not the input of "appropriate" as the evaluation of the image is received. When the input of "appropriate" is received (Yes), the image density adjustment is finished. When the input of "appropriate" is received (No), the process proceeds to ACT 124.

In ACT 124, the image forming apparatus 1 determines whether or not the input of "light" or "slightly light" is received. When one of these inputs is received (Yes), the process returns to ACT 120. Also, the processes subsequent to ACT 121. Meanwhile, when one of these inputs are received (No), the process proceeds to ACT 126.

With the adjustments so far, most of the lack of the image density case can be easily recovered.

As discussed, the adjustments when the image density is light are adjustments for dealing with root causes which have a high possibility of occurring, and the adjustments which are easily performed are tried, it is possible to reliably recover the density without wasting time.

Meanwhile, in ACT 120, when the toner density Dt is determined not to be increased (No), the process proceeds to ACT 125. In ACT 125, the image forming apparatus 1 performs a notification. When the image density is not recovered even when the toner has been replenished to an upper limit of the replenishment amount, it is considered that a fatal error which cannot be fixed with only the adjustments tried so far may have occurred. Therefore, for example, the image forming apparatus 1 displays a message such as "please call a service engineer" on the operation panel 30 and terminates the adjustment process. Alternatively, an auditory notification such as notification by a voice message may be performed. When there is a lack of the toner in the replenishing unit 122, the image forming apparatus 1 may display a message such as "please change toner" on the operation panel 30.

Figure 5A:
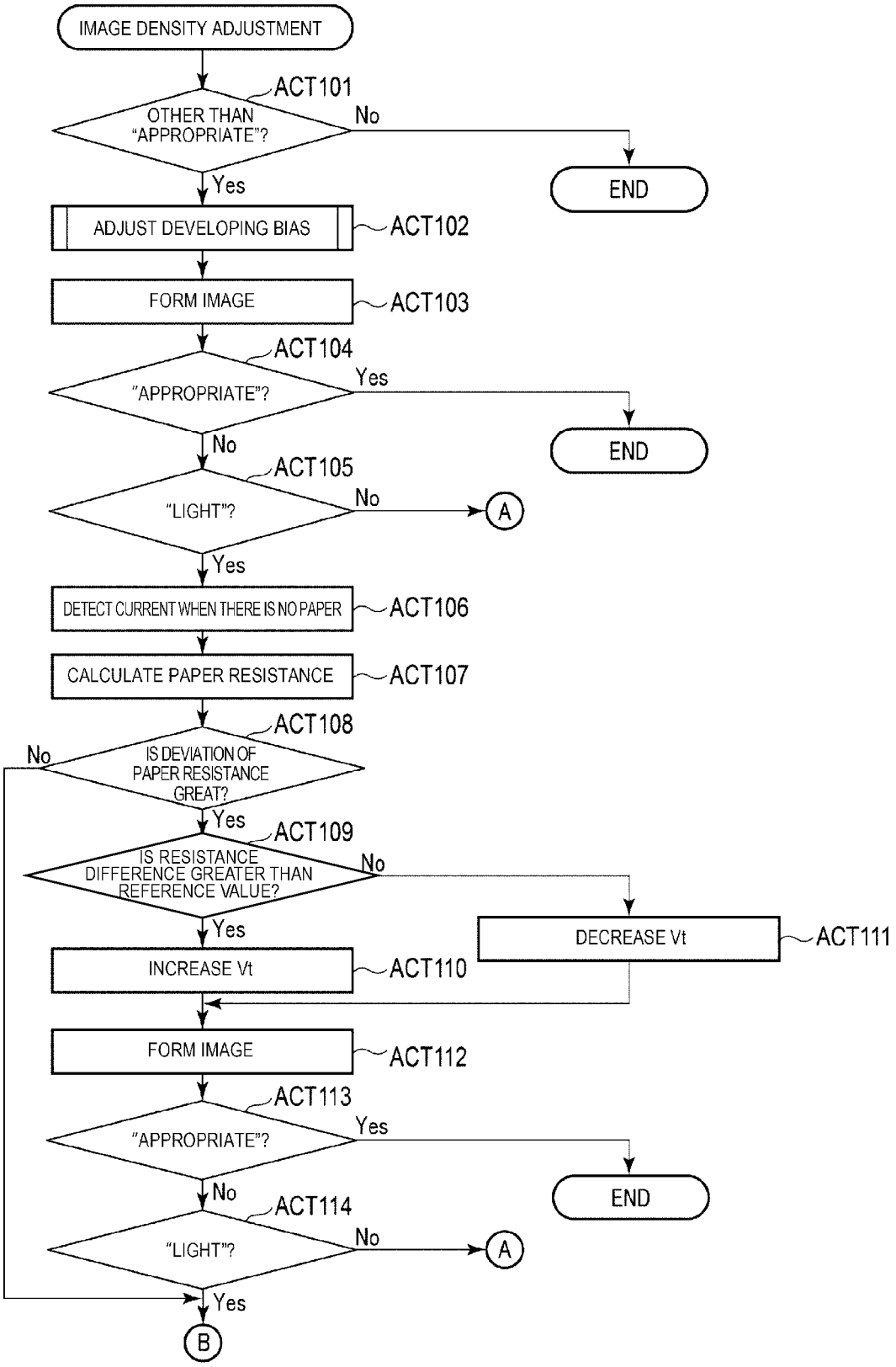
FIG. 5A is a flowchart illustrating aspects of an adjustment method of an image density.
Figure 5B:
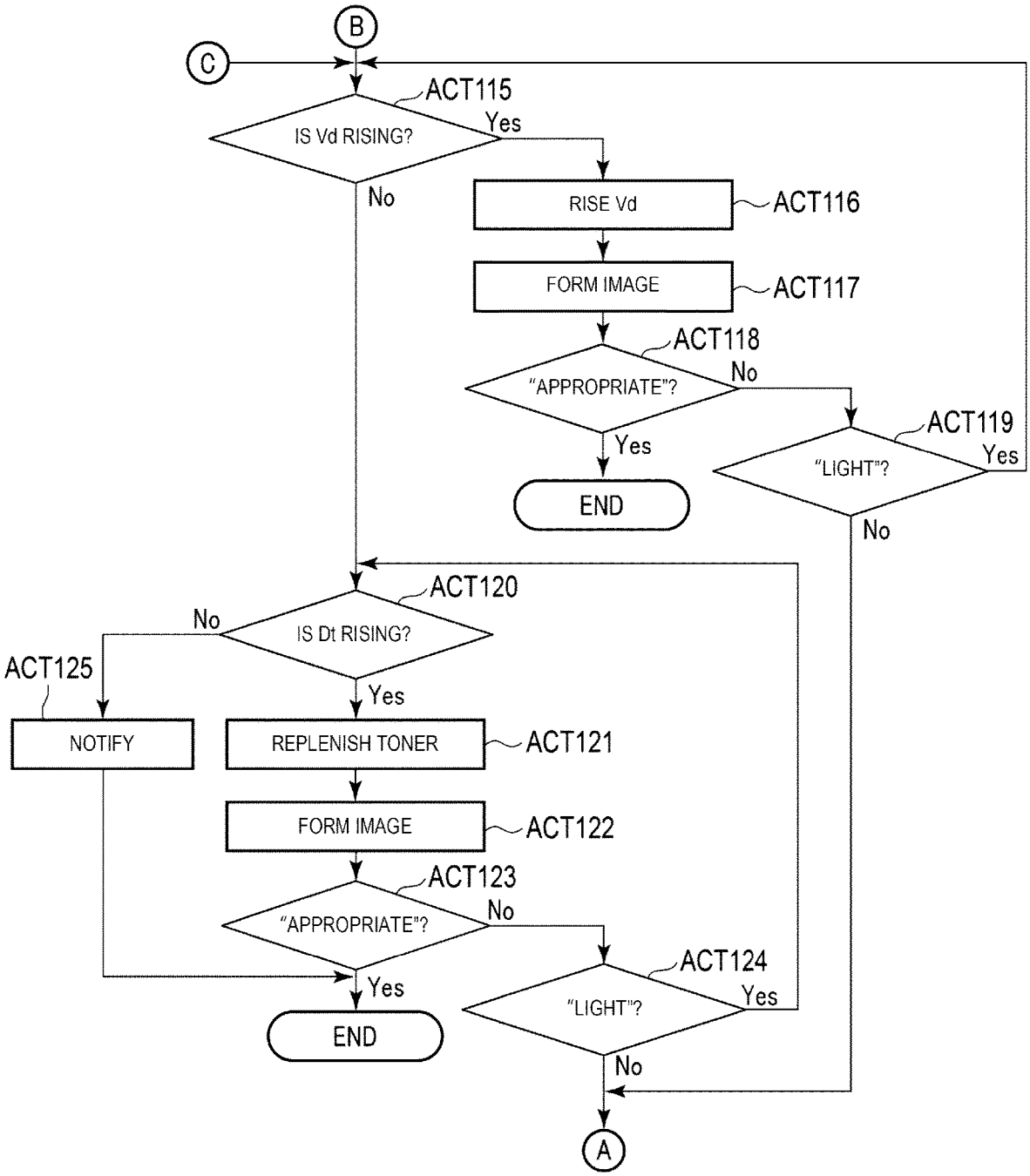
FIG. 5B is a flow chart illustrating aspects of the adjustment method of the image density.
Figure 5C:
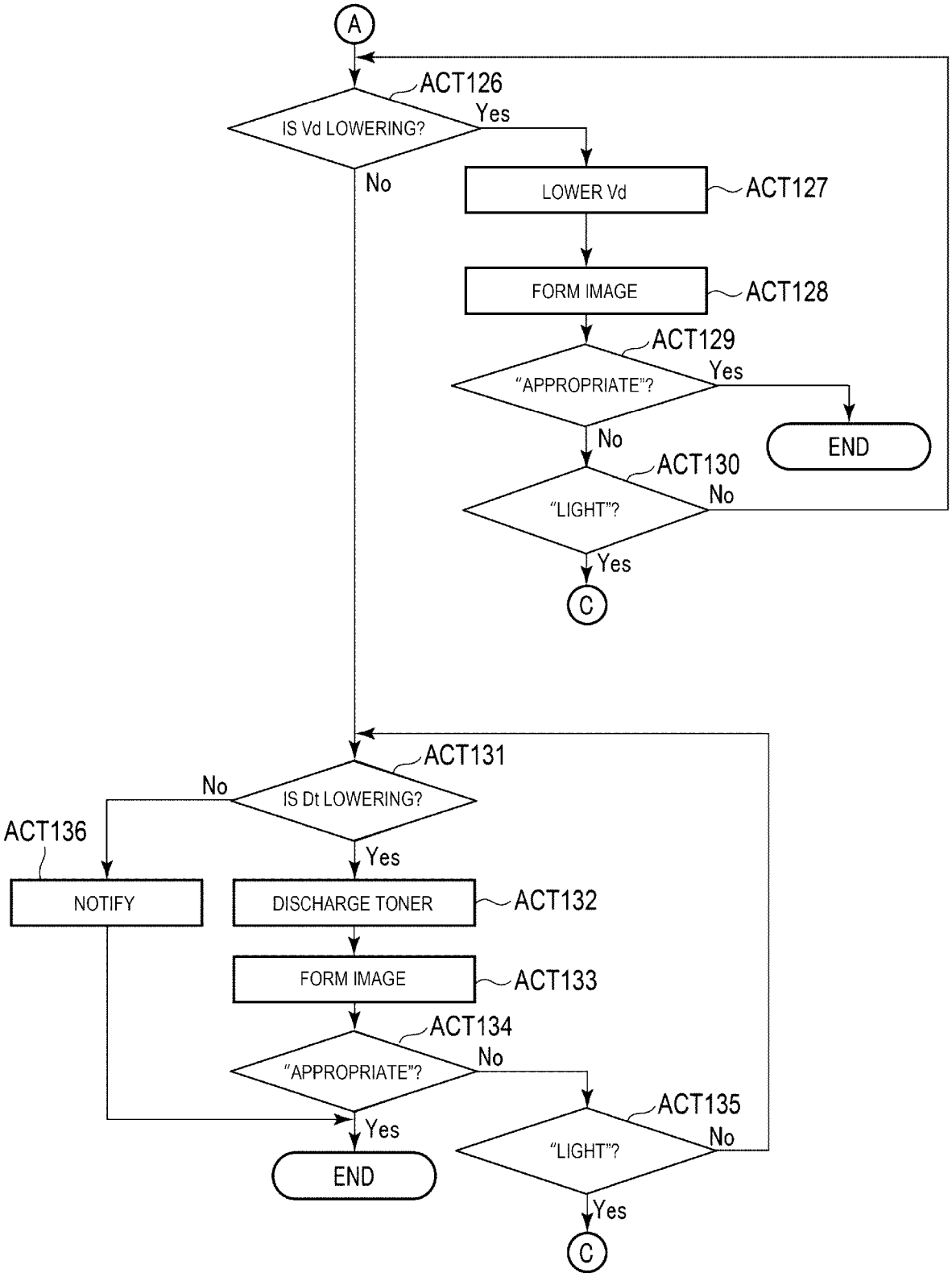
FIG. 5C is a flow chart illustrating aspects of the adjustment method of the image density.

Next, in ACT 105, ACT 114, ACT 119, or ACT 124, a process when the input of "light" or "slightly light" is not received will be described with reference to FIG. 5C. In this case, the process proceeds to ACT 126. Proceeding to ACT 126 occurs when the image forming apparatus 1 receives the input of "dark" or "slightly dark".

The toner image which is transferred onto the intermediate transfer belt 144 by the developing bias adjustment in ACT 102 may already be the "predetermined toner adhesion amount". However, since the user still feels the resulting image is "dark" or "slightly dark", the target toner adhesion amount is set to be less than the "predetermined toner adhesion amount", and the adjustment of the developing bias voltage is performed in the same manner as described above. For example, it is possible to set and adjust the developing bias voltage Vd so that the target toner adhesion amount decreases step by step until the developing bias voltage lowers to a lower limit voltage of developing bias transformer 130. The image forming apparatus 1 performs the adjustment of the developing bias voltage as the second adjustment.

Hereinafter, the developing bias adjustment in ACT 126 to ACT 130 will be described. In ACT 126, the image forming apparatus 1 determines whether or not the developing bias voltage Vd is to be lowered. When the voltage is to be lowered (Yes), the process proceeds to ACT 127. When the voltage is not to be lowered (No), the process proceeds to ACT 131.

In ACT 127, the image forming apparatus 1 lowers the developing bias voltage Vd. For example, a lowering of the developing bias voltage Vd when the input of the evaluation in ACT 105, ACT 114, ACT 119, or ACT 124 is "slightly dark" may be set to be less than that in a case of "dark". A fine adjustment can be performed with such settings.

In ACT 128, the image forming apparatus 1 forms an image on the recording medium 200. After the image forming is completed, the screen for inputting the evaluation of the density of the image is again displayed as illustrated in FIG. 4. The user inputs the evaluation of the density of the image output in ACT 128 from the operation panel 30.

In ACT 129, the image forming apparatus 1 determines whether or not the input of "appropriate" as the evaluation of the image is received. When the input of "appropriate" is received (Yes), the image density adjustment is finished. When the evaluation inputs other than "appropriate" are received (No), the process proceeds to ACT 130.

In ACT 130, the image forming apparatus 1 determines whether or not the input of "light" or "slightly light" is received. If neither of these inputs is received (No), the process returns to ACT 126. Also, the processes subsequent to ACT 126 are repeated. Meanwhile, when "light" or "slightly light" is received (Yes), the process proceeds to ACT 115.

When the image density is evaluated to be still too dark even when the developing bias voltage Vd has been lowered (No in ACT 130 and No in ACT 126), it is considered that a situation in which the density of the image is not lowered with the adjustment of the developing bias voltage may be occurring. Therefore, the image forming apparatus 1 finally adjusts the toner density in processes subsequent to ACT 131. The image forming apparatus 1 adjusts the toner density by discharging toner as a fifth adjustment.

In order to lower the toner density Dt in the developing unit 110, for example, a manner in which an entire solid image test pattern is developed in a no-paper mode and the toner is discharged can be used. A toner image of the developed entire solid image test pattern is collected by the photoconductive cleaner 152 or is collected by the transfer belt cleaner 156 after the toner image is transferred onto the intermediate transfer belt 144. Thus, the toner density Dt is lowered and the image density becomes lighter, and this adjustment is terminated when the user selects "appropriate".

Hereinafter, toner density adjustments in ACT 131 to ACT 135 will be described. In ACT 131, the image forming apparatus 1 determines whether or not the toner density Dt is to be lowered. The image forming apparatus 1, for example, sets a lower limit value for the toner density Dt in advance and determines whether or not the toner density Dt is to be lowered based on the detected value from the toner density sensor 120. When the toner density Dt is to be lowered (Yes), the process proceeds to ACT 132.

In ACT 132, the image forming apparatus 1 discharges the toner by developing the entire solid image toner image described above. For example, the discharged amount of the toner when the input of the evaluation in ACT 129 and ACT 130 is "slightly light" may be set to be less than that in a case of "light". A fine adjustment can be performed with such settings.

In ACT 133, the image forming apparatus 1 forms an image on the recording medium 200. After the image forming is completed, the screen for inputting the evaluation of the density of the image is displayed as illustrated in FIG. 4. The user inputs the evaluation of the density of the image output in ACT 133 from the operation panel 30.

In ACT 134, the image forming apparatus 1 determines whether or not the input of "appropriate" is received. When the input of "appropriate" is received (Yes), the image density adjustment is finished. When the input of "appropriate" is received (No), the process proceeds to ACT 135.

In ACT 135, the image forming apparatus 1 determines whether or not the input of "light" or "slightly light" is received. When one of these inputs is received (Yes), the process proceeds to ACT 115. Also, the processes subsequent to ACT 115 are repeated. That is, as a result of lowering the toner density Dt, when the image density is lowered, adjustment proceeds to a developing bias adjustment or a toner density adjustment subsequent to ACT 115 so as to rise the toner density Dt. Meanwhile, when one of these inputs is not received (No), the process returns to ACT 131.

With the adjustments so far, most cases of darkening of the image density can be recovered.

As seen from the above, even when the image density is dark, the adjustments are for dealing with the causes which have a high possibility of occurring, and it is possible to reliably recover the density without wasting time when the adjustments which are easily performed are tried.

Meanwhile, in ACT 131, when the toner density Dt is determined not to be lowered (No), the process proceeds to ACT 136. In ACT 136, the image forming apparatus 1 performs a notification. For example, the image forming apparatus 1 displays a message such as "please call a service engineer" on the operation panel 30 and finishes the adjustment process. Alternatively, an auditory notification such as notification by a voice message may be performed.

As described above, in the embodiment, a plurality of density adjustments are set in the image forming apparatus 1 in advance. The density adjustment includes, for example, an adjustment of the developing bias voltage, an adjustment of the transfer bias voltage, and an adjustment of the toner density. The image forming apparatus 1 performs one of the prepared density adjustments in advance in accordance with the evaluation of the image density by the user. There are various causes for which variation in image density is not appropriate, and failure of the image density does not always occur by the same causes. Since the settings of the developing unit 110 are not appropriate, a defect of the image density may occur, and since settings of the transfer unit 148 are not appropriate, the defect of the image density may occur. According to the embodiment, when various equipment of the image forming apparatus 1 are adjusted in accordance with user evaluations, it is possible to efficiently perform the image density adjustment. In the embodiment, it is possible to efficiently obtain an appropriate density by a user evaluation.

In the embodiment, in a case of the defect of the image density (light or dark), when a defect having high possibility as a cause thereof or a defect not requiring substantial time for adjustment is preferentially adjusted, it is possible to more appropriately and promptly perform the density adjustment. Generally, specification of the particular causes of the defects of image density is not easily performed unless performed by experienced technicians. However, according to the embodiment, it is possible to more efficiently resolve the defect of the image density regardless of the availability of such technicians.

According to the embodiment, a user who is merely an end user rather than a technician or a service engineer can try various density adjustments himself or herself without calling a service engineer. For example, there is a case in which a default image density may be not matched with a preference of the user. Such a mismatch between user preference and output settings is not the result of an abnormality in the image forming apparatus 1. In such situations, the image density evaluation by the user results in evaluations other than "appropriate" even though no abnormality occurs, thus it is useful that a density adjustment matching with a preference of the user can be performed without a service call or the like. Even when the service engineer visits and does not make individual settings to match user subjective preferences with respect to image density, the user can still set density settings matching with their preference by himself or herself.

In addition, if the density settings are left entirely to a preference of the user, failures (for example, failure relating to the setting of toner density) of the image forming apparatus 1 can be caused. However, in the embodiment, since the image forming apparatus 1 tries to perform an adjustment which is more easily performed among the possible adjustments in accordance with the evaluations of the user, such failure is not easily caused.

As the adjustment mode for the image density adjustment, the adjustment of the developing bias voltage, the adjustment of the secondary transfer bias voltage, and the adjustment of the toner density of the developer are exemplified, but other adjustments may be established in advance. For example, the image forming apparatus 1 may perform adjustment of the primary transfer bias voltage for the density adjustment or an adjustment of an exposure volume of the exposure unit 140.

In the embodiment, after the adjustment of the developing bias voltage, the transfer bias voltage is adjusted when the density is light, and the developing bias voltage is adjusted to be lowered when the density is dark; however, adjustments other than these adjustments described above may be performed. That is, as described above, the image forming apparatus 1 may perform any one of density adjustments established in advance in accordance with the evaluation of the image density by the user as long as the user can try various adjustments so as to evaluate the image density.

In addition, the example in which the evaluation of the image density by the user is input from the operation panel 30 is described, but the user may input the evaluation from the other evaluation inputting devices. For example, the evaluation may be input from external equipment such as a PC connected to the image forming apparatus 1 through a network.

A so-called image forming apparatus 1 of a quadruple tandem intermediate transfer system is exemplified, but a concept of the embodiment can also be applied to other image forming apparatuses. For example, the image density adjustments are described using the color image forming apparatus 1 including four colors of the developing units 110C, 110M, 110Y, and 110K, but the adjustments can also be performed in a monochrome image forming apparatus. In this case, the toner adhesion amount sensor 146 detects a toner pattern on a surface of a photoconductive member. In addition, the secondary transfer roller 148B is a simple transfer roller. The image forming apparatus is not required to be a multi-functional peripheral device.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a developing unit configured to supply a toner to an image carrier and form a toner image thereon;

a transfer unit configured to transfer the toner image on the image carrier to a recording medium and form an image on the recording medium;

a power source unit configured to supply a developing bias voltage to the developing unit and a transfer bias voltage to the transfer unit;

an input device configured to receive an evaluation input from a user, the evaluation input indicating a user evaluation of an image density of the image on the recording medium; and a processor configured to:

perform a first adjustment for adjusting the developing bias voltage when the input device receives an evaluation input indicating that the image density is not appropriate according to the user evaluation, enter an adjustment mode when the input device receives an evaluation input indicating that the image density is not appropriate according to the user evaluation after the first adjustment has been performed, and perform any one of an adjustment of the developing bias voltage, an adjustment of the transfer bias voltage, and an adjustment of the toner density in the developing unit as a second adjustment in the adjustment mode in accordance with the evaluation input received after the first adjustment, wherein the processor performs:

the adjustment of the transfer bias voltage as the second adjustment when the input device receives an evaluation input indicating that the image density is low, and the adjustment of the developing bias voltage as the second adjustment when the input device receives an evaluation input indicating that the image density is high.

2. The apparatus according to claim 1, wherein the adjustment mode continues until the input device receives an evaluation input indicating that the image density is appropriate according to the user evaluation.

3. The apparatus according to claim 2, wherein the adjustment mode ends only when the input device receives the evaluation input indicating that the image density is appropriate.

4. The apparatus according to claim 1, wherein the processor performs a third adjustment after the second adjustment is performed if the input device receives, after performance of the second adjustment, another evaluation input indicating that the image density is not appropriate according to the user evaluation, the third adjustment and the second adjustment being of different types from one another.

5. The apparatus according to claim 1, wherein, when the input device receives the evaluation input indicating that the image density is low after the second adjustment, the processor adjusts the developing bias voltage.

6. The apparatus according to claim 5, further comprising:

a replenishing unit configured to store a toner and add toner to the developing unit, wherein the processor adjusts the developing bias voltage again if the input device receives another evaluation input indicating that the image density is low after a previous adjustment in developing bias voltage or causes the replenishing unit to add the toner to the developing unit if the developing bias voltage has reached a predetermined level.

7. The apparatus according to claim 1, wherein the processor performs the second adjustment again if the input device receives another evaluation input indicating that the image density is high after a previous performance of the second adjustment or otherwise causes the toner in the developing unit to be discharged if the developing bias voltage has reached a predetermined level.

8. The apparatus according to claim 1, wherein the processor acquires an electrical characteristic of the recording medium at the time of transferring the toner image to the recording medium and adjusts the transfer bias voltage in accordance with the acquired electrical characteristic.

9. An image density adjustment method for an image forming apparatus, the method comprising:

performing a first adjustment for adjusting a developing bias voltage of the image forming apparatus if an evaluation input indicating that image density of the image forming apparatus is not appropriate according to a user evaluation is received, entering an adjustment mode if an evaluation input indicating that the image density is not appropriate according to the user evaluation is received after the first adjustment has been performed, and performing any one of an adjustment of the developing bias voltage, an adjustment of a transfer bias voltage of the image forming apparatus, and an adjustment of a toner density in a developing unit of the image forming apparatus as a second adjustment in the adjustment mode in accordance with the evaluation input received after the first adjustment, wherein after the first adjustment, the adjustment of the transfer bias voltage is performed as the second adjustment if an evaluation input indicating that the image density is low is received, and the adjustment of the developing bias voltage is performed as the second adjustment if an evaluation input indicating that the image density is high is received.

10. The method according to claim 9, wherein the adjustment mode is continued until an evaluation input indicating that the image density is appropriate according to the user evaluation is received.

11. The method according to claim 10, wherein the adjustment mode is ended only when the evaluation input indicating that the image density is appropriate is received.

12. The method according to claim 10, further comprising:

performing a third adjustment after the performing of the second adjustment if another evaluation input indicating that the image density is not appropriate according to the user evaluation is received, the third adjustment and the second adjustment being of different types from one another.

13. The method according to claim 9, wherein, when the evaluation input indicating that the image density is low is received after the performing of the second adjustment, the developing bias voltage is adjusted.

14. The method according to claim 13, further comprising:

adjusting the developing bias voltage again if another evaluation input indicating that the image density is low after a previous adjustment in developing bias voltage; and causing a replenishing unit of the image forming apparatus to add the toner to the developing unit when the developing bias voltage has reached a predetermined level and another evaluation input indicating that the image density is low is received after a previous adjustment in developing bias voltage.

15. The apparatus according to claim 9, further comprising:

performing the second adjustment again if another evaluation input indicating that the image density is high is received after a previous second adjustment; and causing the toner in the developing unit to be discharged if the developing bias voltage has reached a predetermined level in a previous second adjustment.

16. The apparatus according to claim 9, further comprising:

acquiring an electrical characteristic of the recording medium at the time of transferring a toner image to a recording medium in the image forming apparatus and adjusting the transfer bias voltage in accordance with the acquired electrical characteristic.

17. An image density adjustment method for an image forming apparatus, the method comprising:

adjusting a developing bias voltage of a developing unit in the image forming apparatus when an input device of the image forming apparatus receives a first evaluation input indicating that image density of an image formed on a recording medium by the image forming apparatus is not appropriate according to a user evaluation, entering an adjustment mode when the input device receives a second evaluation input indicating that the image density is still not appropriate according to the user evaluation after the first adjustment has already been performed, and in the adjustment mode, adjusting a transfer bias voltage of a transfer unit of the image forming apparatus if the second evaluation input indicates that image density is low, and adjusting the developing bias voltage if the second evaluation input indicates the image density is high.

* * * * *